US010002688B2

(12) United States Patent
Harwath

(10) Patent No.: US 10,002,688 B2
(45) Date of Patent: Jun. 19, 2018

(54) FLEXIBLE ELECTRICAL POWER CABLE

(71) Applicant: CommScope Technologies LLC, Hickory, NC (US)

(72) Inventor: Frank A. Harwath, Naperville, FL (US)

(73) Assignee: CommScope Technologies LLC, Hickory, NC (US)

( * ) Notice: Subject to any disclaimer, the term of this patent is extended or adjusted under 35 U.S.C. 154(b) by 0 days. days.

(21) Appl. No.: 15/092,145

(22) Filed: Apr. 6, 2016

(65) Prior Publication Data

US 2016/0217884 A1 Jul. 28, 2016

Related U.S. Application Data

(63) Continuation of application No. 13/561,115, filed on Jul. 30, 2012.

(51) Int. Cl.
*H01B 7/08* (2006.01)
*H01B 7/00* (2006.01)
(Continued)

(52) U.S. Cl.
CPC ..... *H01B 7/0009* (2013.01); *H01B 1/023* (2013.01); *H01B 3/307* (2013.01); *H01B 3/443* (2013.01);
(Continued)

(58) Field of Classification Search
CPC ..... H01B 1/023; H01B 3/307; H01B 3/427; H01B 3/441; H01B 3/443; H01B 3/447; H01B 7/08; H01B 7/0009; H01B 7/0018; H01B 7/0823; H01B 7/0838; H01B 7/0861; H01B 7/303; H05K 1/0393; H05K 3/28;
(Continued)

(56) References Cited

U.S. PATENT DOCUMENTS 2,200,776 A 5/1940 Hoober
3,586,757 A 6/1971 Haldeman, Jr.
(Continued)

FOREIGN PATENT DOCUMENTS

JP 2000133071 A 5/2000
JP 2004119240 A * 4/2004
(Continued)

OTHER PUBLICATIONS

Jeong, International Search Report for PCT/US2014/044275, dated Oct. 16, 2014, Daejeon Metropolitan City, Korea.
(Continued)

*Primary Examiner* — Timothy Thompson
*Assistant Examiner* — Guillermo Egoavil
(74) *Attorney, Agent, or Firm* — Myers Bigel, P.A.

(57) ABSTRACT

An electrical cable has a plurality of generally rectangular cross-section conductors superposed in a stack, the stack surrounded by a polymer jacket. The stack may be provided with a lubrication layer provided between at least two of the conductors. Conductors of the stack may have a thickness that is greater proximate the middle of the stack than at the top and bottom of the stack and/or a width that is less at the top and the bottom than at the middle. Further stacks may also be provided parallel and coplanar with the first stack, also surrounded by the polymer jacket.

13 Claims, 6 Drawing Sheets

(51) Int. Cl.
*H01B 1/02* (2006.01)
*H01B 3/30* (2006.01)
*H01B 3/44* (2006.01)

(52) U.S. Cl.
CPC ..... *H01B 3/447* (2013.01); *H01B 7/0018* (2013.01); *H01B 7/08* (2013.01); *H01B 7/0823* (2013.01)

(58) Field of Classification Search
CPC .. H05K 3/4626; H05K 3/4635; H05K 3/4652; H05K 3/4655; H05K 2201/015; H05K 2201/0154; Y10T 29/49124; G02B 6/441; G02B 6/448; G02B 6/449; G02B 6/4411
USPC ..... 156/50, 73.2; 174/113 R, 116, 117 FF; 385/110, 114
See application file for complete search history.

(56) References Cited

U.S. PATENT DOCUMENTS 3,828,120 A 8/1974 Hansen
4,051,809 A 10/1977 Zickar et al.
5,761,363 A * 6/1998 Mills ..... G02B 6/4403 385/114
5,847,324 A * 12/1998 Farquhar ..... H01B 7/0838 174/117 FF
5,850,773 A * 12/1998 Burns ..... B21F 1/026 140/140
6,005,193 A 12/1999 Markel
6,103,804 A * 8/2000 Davis ..... C09K 3/1018 156/329
6,110,589 A * 8/2000 Harwood ..... C08L 81/02 428/364
6,218,622 B1 4/2001 Rimmer
6,256,439 B1 * 7/2001 Brown ..... G02B 6/4411 385/110
6,340,795 B1 1/2002 Caldwell
6,371,773 B1 * 4/2002 Crofoot ..... H01R 23/688 439/607.08
6,581,291 B1 6/2003 Tarpill et al.
6,608,256 B2 8/2003 Suzuki et al.
8,193,452 B2 * 6/2012 Tillner ..... H01F 27/2847 174/117 FF
2002/0060087 A1 * 5/2002 Ueno ..... H01B 7/0045 174/117 F
2002/0195478 A1 12/2002 Yamano et al.
2003/0055185 A1 * 3/2003 Peterson ..... C08F 10/02 526/160
2006/0016615 A1 1/2006 Schilson et al.
2006/0254051 A1 * 11/2006 Huber ..... B60R 16/0215 29/846
2008/0029290 A1 2/2008 Kuo
2008/0142145 A1 * 6/2008 Xu ..... H01B 3/427 156/73.2
2010/0043963 A1 * 2/2010 Trummer ..... B22F 1/0011 156/272.8
2011/0155417 A1 * 6/2011 Hu ..... H01B 7/0018 174/116
2011/0198109 A1 * 8/2011 Nabeshima ..... C08G 18/346 174/120 C
2012/0181060 A1 7/2012 Chen et al.

FOREIGN PATENT DOCUMENTS

JP 2010135138 A 6/2010
KR 1020050087545 1/2006
WO WO 2004059804 A1 * 7/2004 ..... H01R 12/61
WO WO2007140488 A1 12/2007

OTHER PUBLICATIONS

Kim, International Search Report for PCT/US2013/0040028, dated Sep. 27, 2013, Daejeon Metropolitan City, Korea.
Extended Search Report for corresponding EP Application No. 13825068.3, dated Jun. 27, 2016, 11 pages.

* cited by examiner

FLEXIBLE ELECTRICAL POWER CABLE

RELATED APPLICATION

The present application is a continuation of U.S. patent application Ser. No. 13/561,115, filed Jul. 30, 2012, the disclosure of which is hereby incorporated herein in its entirety.

BACKGROUND OF THE INVENTION

RF transceivers have traditionally been located on the ground and RF signals transmitted to/received from antennas mounted atop radio towers interconnected with the RF transceivers by RF coaxial cables. A move towards remote radio head (RRH) installations, wherein the RF transceivers are themselves located atop radio towers proximate the antennas, has reduced the need for RF coaxial cables to transmit the RF signals between the transceiver and the antenna, but has also increased the demand for electrical power at the top of the radio tower.

Traditional electrical power cables comprise large gauge copper conductors with a circular cross section. However, such power cables are heavy, difficult to bend and have a high material cost directly related to the rising cost of copper metal.

Cost and weight efficient aluminum power cables are known. However, to deliver the same current capacity an aluminum power cable requires an increased cross-sectional area. Also, a differential in the thermal expansion coefficient of aluminum material cables and that of the various metals comprising connections/connectors is a cause of aluminum cable electrical interconnection reliability issues, which increase as the diameter of the clamped portion of the aluminum conductor increases.

As the diameter of a power cable increases with increasing power capacity, the bend radius of the power cable increases.

Competition within the electrical power transmission cable and in particular the Remote Radio Head systems market has focused attention upon reducing materials and manufacturing costs, providing radio tower electrical power delivery and overall improved manufacturing quality control.

Therefore, it is an object of the invention to provide an electrical power cable and method of manufacture that overcomes deficiencies in such prior art.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

The inventor has recognized that the prior accepted circular cross section power cable design paradigm results in unnecessarily large power cables with reduced bend radius, excess metal material costs and/or significant additional manufacturing process requirements.

Figure 1:
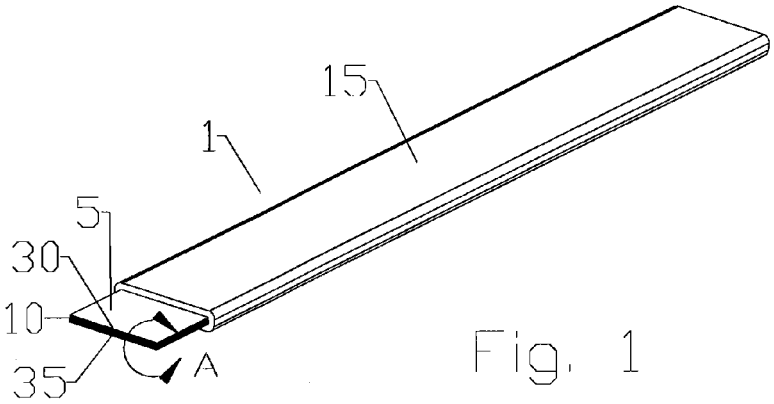
FIG. 1 is a schematic isometric view of an exemplary electric cable with the jacket stripped back to expose the conductor stack.
Figure 2:
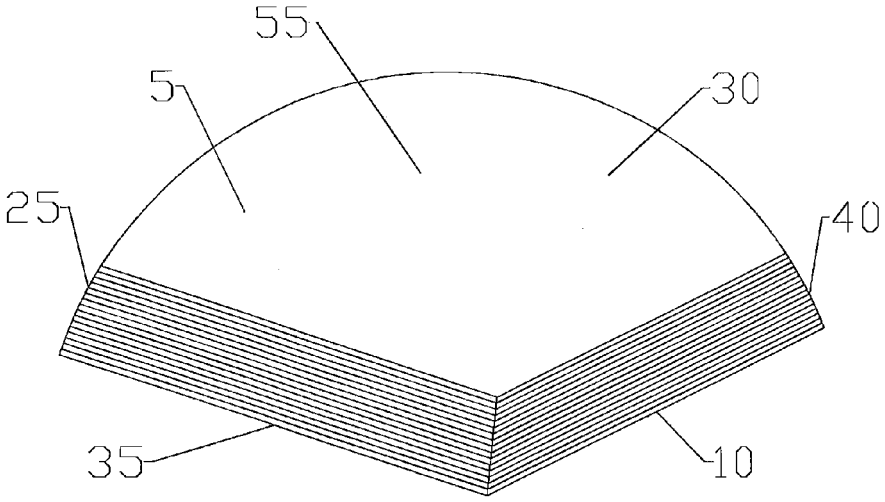
FIG. 2 is a close-up view of area A of FIG. 1.

An exemplary flexible aluminum power cable 1 is demonstrated in FIGS. 1-5. As best shown in FIG. 2, the power cable 1 may be formed with a plurality of separate generally planar conductors 5 superposed in a stack 10, the stack 10 surrounded by a jacket 15. For example, a stack 10 of 16 layers of 0.005" thick and 1" wide aluminum conductors 5 provides a cable 1 with current characteristics generally equivalent to 1/0 AWG standard circular cross section insulated aluminum power cable.

Figure 3:
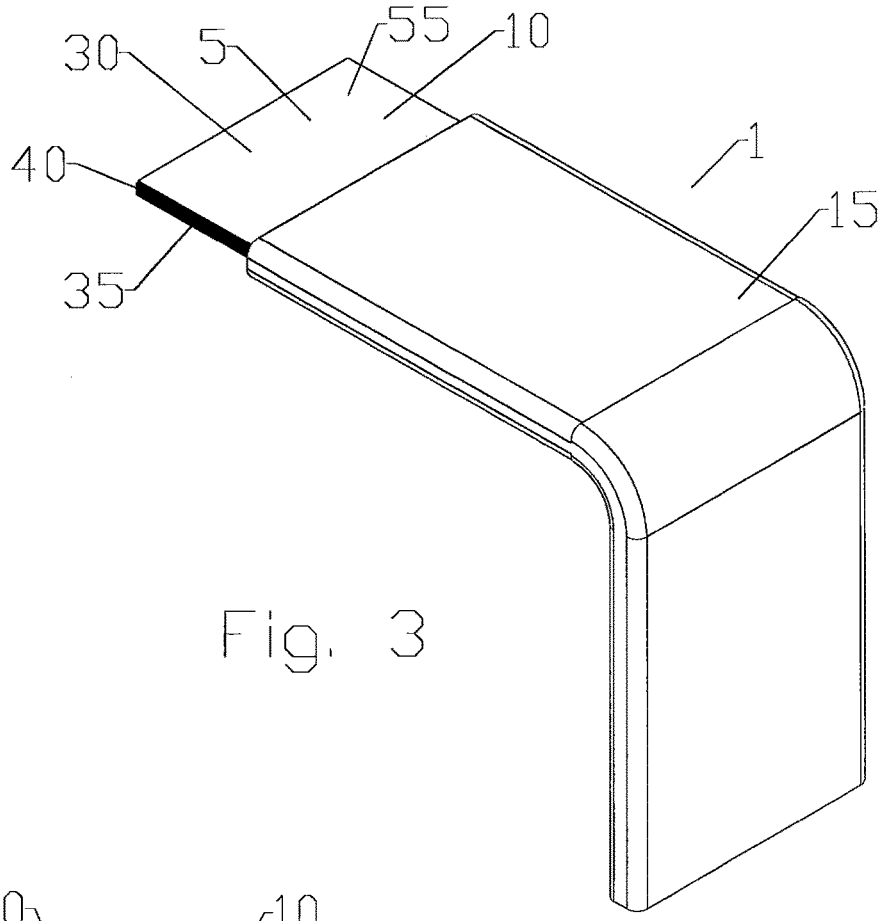
FIG. 3 is a schematic isometric view demonstrating a bend radius of the electrical cable of FIG. 1.
Figure 4:
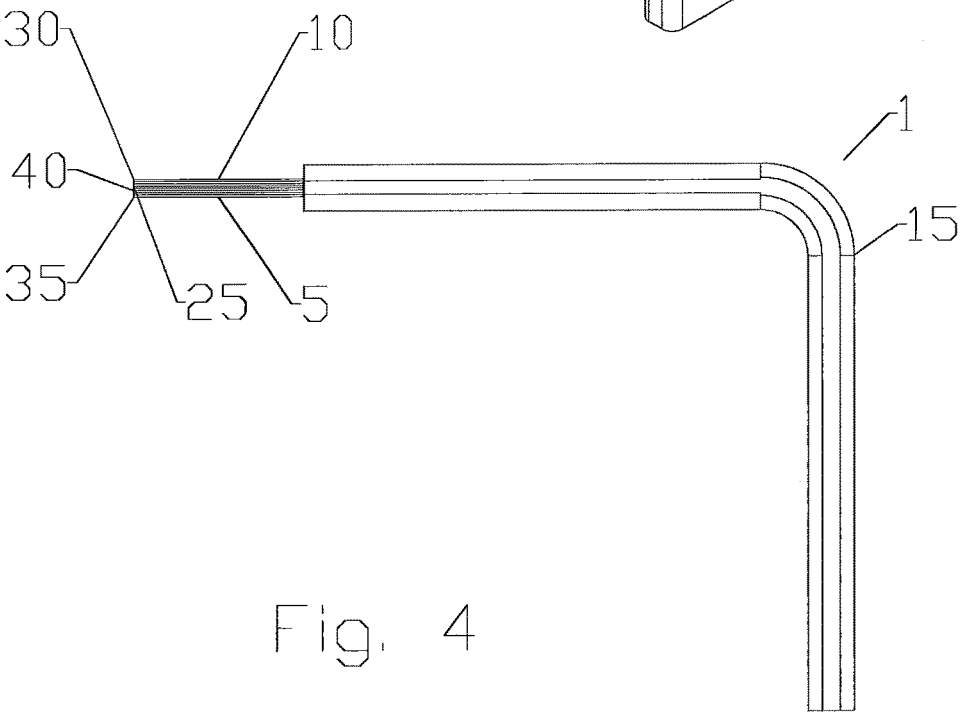
FIG. 4 is a schematic side view of the cable of FIG. 3.
Figure 5:
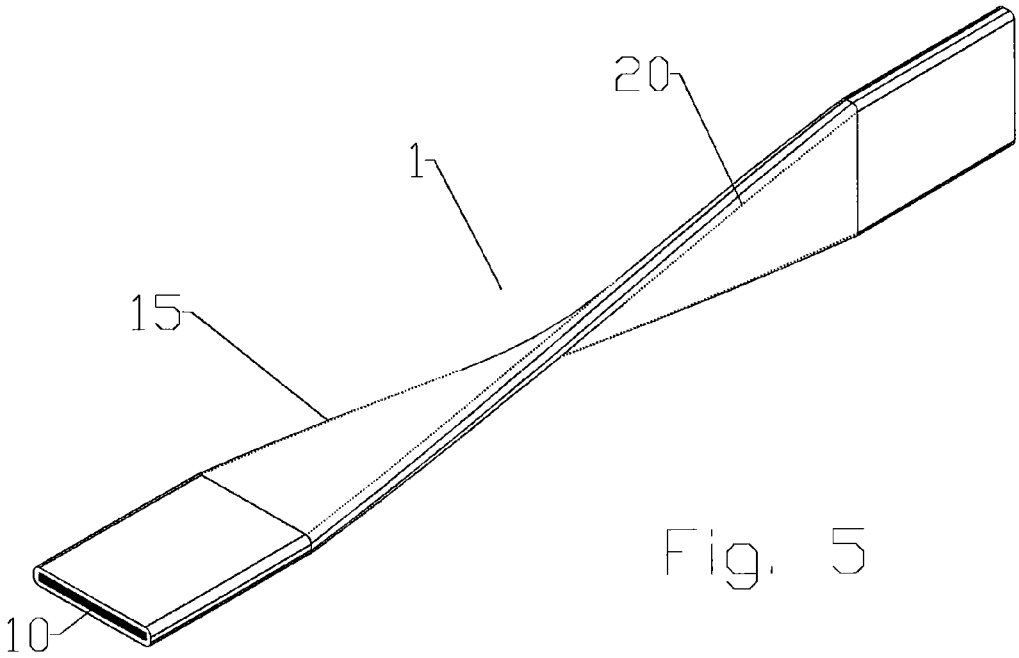
FIG. 5 is a schematic isometric view of an exemplary embodiment of the electrical cable demonstrating application of a twist to the electrical cable to obtain a reduced bend radius also in another desired direction.
Figure 6:
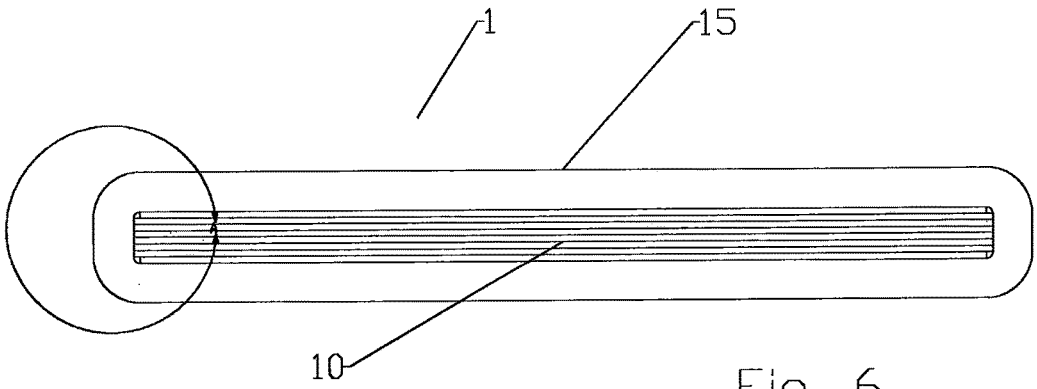
FIG. 6 is a schematic end view of an alternative embodiment of the electrical cable, demonstrating edge reduction via shortened widths of the top and bottom conductors.
Figure 7:
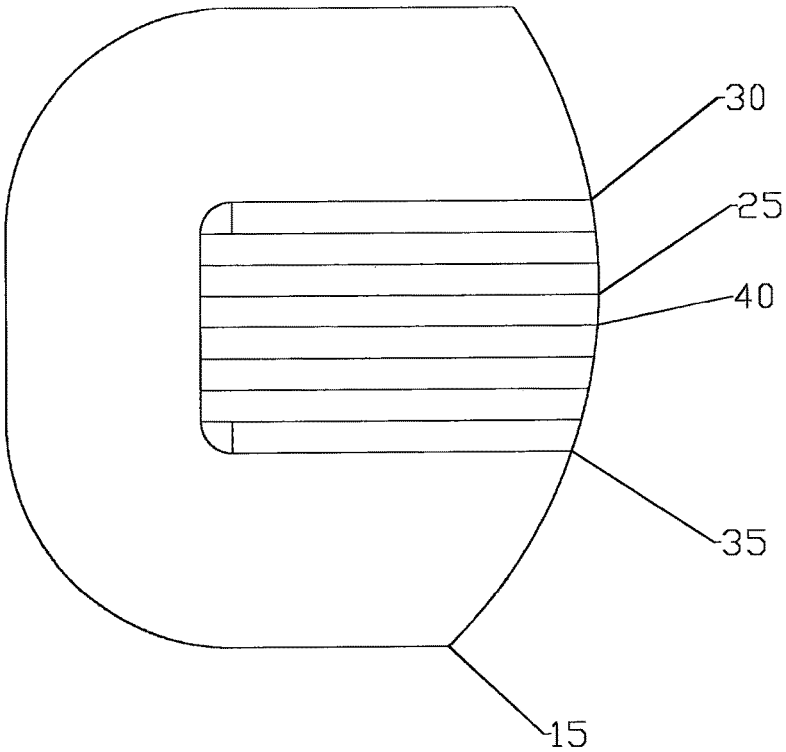
FIG. 7 is a close-up view of the cable of FIG. 6.
Figure 8:
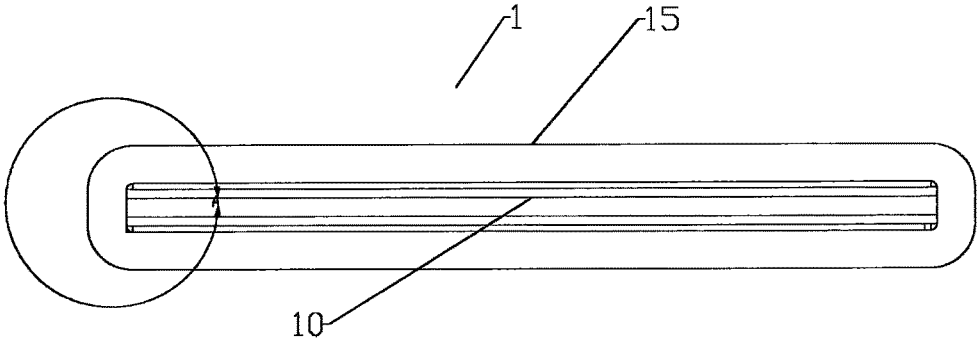
FIG. 8 is a schematic end view of another alternative embodiment of the electrical cable, demonstrating edge reduction via shortened widths of the top and bottom conductors and conductor thickness variation with a maximum width proximate the middle of the conductor stack.
Figure 9:
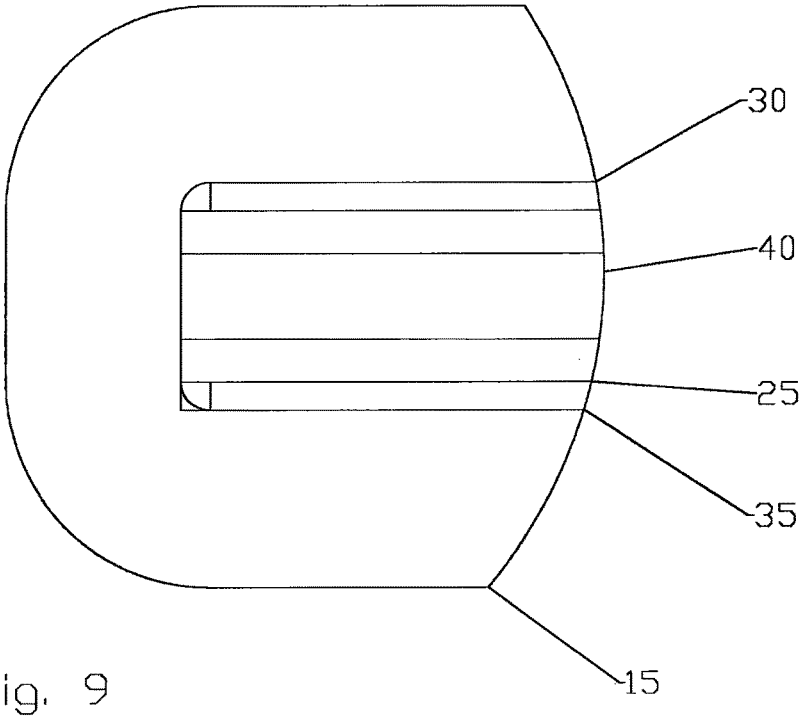
FIG. 9 is a close-up view of the cable of FIG. 8.

The flattened characteristic of the cable 1 has inherent bend radius advantages. When the bending moment is applied across the narrow dimension of a rectangular conductor 1, the bending radius may be dramatically reduced. For a circular cross section, the bending moment is proportional to radius^4 (any direction). However, along the thin dimension of a rectangular cross section, the bending moment is significantly smaller. As best shown in FIGS. 3 and 4, the bend radius of the cable perpendicular to the horizontal plane of the stack 10 of conductors 5 is significantly reduced compared to a conventional power cable of equivalent materials dimensioned for the same current capacity. Since the cable thickness between the top and the bottom may be significantly thinner than the diameter of a comparable circular cross section power cable with the same total cross sectional area, distortion or buckling of the power cable is less likely at a given bend radius. One skilled in the art will appreciate that to obtain the improved flexibility of the cable 1 also in the vertical plane (or some other desired angle), a twist 20 may be applied along the longitudinal axis of the cable 1, for example as shown in FIG. 5. Thereby, installation and routing requirements for the cable between the power source and, for example, the top of a radio tower may be simplified.

A tighter bend radius also improves warehousing and transport aspects of the cable 1, as the cable 1 may be packaged more efficiently, for example provided coiled upon smaller diameter spool cores which require less overall space.

The bend radius may be further improved by enabling the several conductors of the stack to move with respect to one another as a bend is applied to the cable 1. Application of a lubrication layer 25 between at least two of the conductors 5 facilitates the movement of the conductors 5 with respect to one another as a bend is applied to the cable 1. Thereby, conductors 1 closest to the bend radius may establish a shorter path than conductors at the periphery of the bend radius, without applying additional stress to the individual conductors 5 of the cable 1, overall.

The lubrication layer 25 may be applied as any material and/or coating which reduces the frictional coefficient between conductors 5 to below the frictional coefficient of a bare conductor 5 against another bare conductor 5. The lubrication layer 25 by be applied as a layer/coating of, for example, synthetic hydrocarbons, solvent based vanishing lubricants, molybdenum disulfide, tungsten disulfide, other dry lubricants like mica powder or talc, waxes, primary branched alcohol and ester based additives, primary linear alcohols and lauric acid based additives, soap and non-soap based greases, polymer based lubricant, ester based lubricant, mineral oil based protective coating fluid, blends of mineral and synthetic oils. Further, the selected lubrication layer 25 may be semisynthetic emulsifiable.

The jacket 15 may be formed with, for example, polymer materials such as polyethylene, polyvinyl chloride, polyurethane and/or rubbers applied to the outer circumference of the stack 10. The jacket 15 may comprise laminated multiple jacket layers to improve toughness, strippability, burn resistance, the reduction of smoke generation, ultraviolet and weatherability resistance, protection against rodent gnaw through, strength resistance, chemical resistance and/or cut-through resistance.

The edges of the stack 15 may present a sharp corner edge prone to snagging and/or tearing. To apply a smoother radius to the corner edges of the cable 1, the top conductor 30 and bottom conductor 35 may be provided with a width that is less than a width of a middle conductor 40 proximate the middle of the stack 10, for example as shown in FIGS. 6-9, to improve an edge tear strength characteristic of the cable 1.

The shortest bend radius will be applied to the top conductor 30 or bottom conductor 40 (depending upon the desired direction of bend) of the stack 10. As shown for example in FIGS. 8 and 9, the thickness of the conductors 5 may be adjusted such that a thickness of the top conductor 30 and the bottom conductor 35 of the stack 10 is less than a thickness of the middle conductor 40 proximate a middle of the stack 10. Thereby, tensile strength of the cable may be increased in a compromise that has reduced impact upon the overall bendability characteristic of the cable 1.

Figure 10:
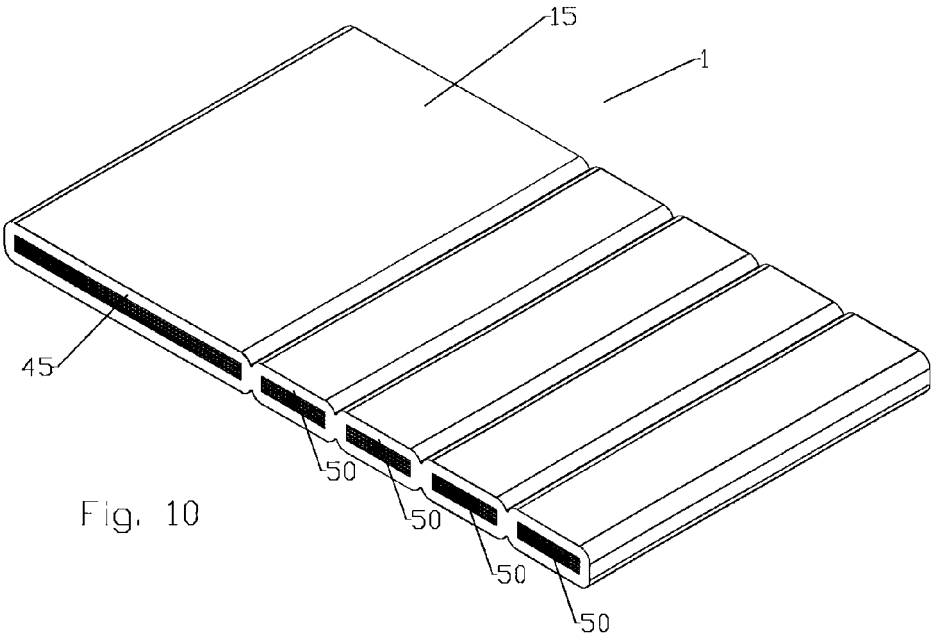
FIG. 10 is a schematic isometric view of a multiple conductor stack embodiment of the electrical cable.
Figure 11:
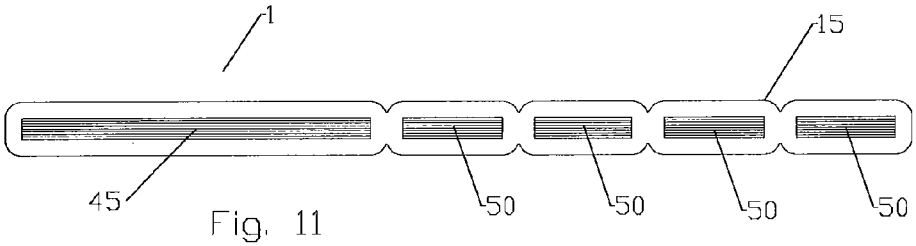
FIG. 11 is a schematic end view of the cable of FIG. 10.

Multiple conductor stacks 10 may be applied to form a multiple conductor flexible power cable 1, for example as shown in FIGS. 10 and 11. The multiple conductor stacks 10 may be aligned parallel and co-planar with each other, to maintain the improved bendability characteristic of the individual conductors 5 perpendicular to the horizontal plane of the several conductor stacks 10. The multiple conductor flexible power cable 1 may also be optimized to provide conductors of varied current capacity within the same cable 1, for example providing a stack 10 configured as a main current supply bus 45 and a separate stack 10 of return/switching conductors 50 from each power consumer. To provide an increased current capacity in such main current supply bus 45, this first stack 10 may be provided with a width that is greater than a width of the several second stack(s) provided as the return/switching conductors 50.

One skilled in the art will appreciate that the cable 1 has numerous advantages over a conventional circular cross section copper power cable. Because the desired cross sectional area may be obtained without applying a circular cross section, an improved bend radius may be obtained. If desired, the significant improvements to the bend radius enables configuration of the cable 1 with increased cross sectional area. This increased total cross sectional area, without a corresponding increase in the minimum bend radius characteristic, may also enable substitution of aluminum for traditional copper material, resulting in materials cost and weight savings. Where aluminum conductors 5 are applied, a termination characteristic, for example by soldering, and/or corrosion resistance of the aluminum conductors 5 may be improved by coating at least one side of one of the individual aluminum conductors 5 with a coating 55, such as copper.

One skilled in the art will appreciate that in addition to the aluminum versus copper material cost savings, a weight savings for an electrical cable with aluminum conductors installed upon a radio tower is especially significant, as an overall weight savings enables a corresponding reduction in the overall design load of the antenna/transceiver systems installed upon the radio tower/support structure. Further, the improved bending characteristics of the flexible electrical power cable may simplify installation in close quarters and/or in remote locations such as atop radio towers where conventional bending tools may not be readily available and/or easily applied. Finally, because complex stranding structures which attempt to substitute the solid cylindrical conductor with a woven multi-strand conductor structure to improve the bend radius of conventional circular cross section electrical power cables may be eliminated, required manufacturing process steps may be reduced and quality control simplified.

The inventor has also recognized a further benefit of the invention with respect to handling the effects of a differential in the thermal coefficient of expansion encountered, for example, when aluminum conductors are terminated in steel or copper interconnection/termination structures. One skilled in the art will appreciate that when the cable 1 is terminated by clamping the stack 10 between the top and bottom, that is along the thin dimension of the flat cable, the thickness of the aluminum cable material across which a differential in thermal expansion coefficient relative to the interconnection/termination structure material will apply is reduced dramatically, compared to, for example, a conventional circular cross section cable.

Table of Parts

| | |
|---|---|
| 1 | cable |
| 5 | conductor |
| 10 | stack |
| 15 | jacket |
| 20 | twist |
| 25 | lubrication layer |
| 30 | top conductor |
| 35 | bottom conductor |
| 40 | middle conductor |
| 45 | main current supply bus |
| 50 | return/switching conductor |
| 55 | coating |

Where in the foregoing description reference has been made to ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

We claim:

1. An electrical cable, comprising:

a first plurality of generally rectangular cross-section conductors superposed in a first stack adjacent one another;

a second plurality of generally rectangular cross-section conductors superposed in a second stack adjacent one another, wherein the second stack is aligned substantially parallel and coplanar with the first stack;

a thickness of a top conductor and a bottom conductor of the first stack is less than a thickness of a middle conductor proximate a middle of the first stack;

the conductors of the first stack provided with a conductor horizontal width dimension greater than a conductor vertical height dimension, the conductors of the first stack superposed along the conductor vertical height dimension;

a lubrication layer provided between at least two of the conductors of the first stack and between at least two of the conductors of the second stack;

the lubrication layer is selected from the group consisting of solvent based vanishing lubricants, molybdenum disulfide, tungsten disulfide, wax, primary branched alcohol, ester based additive, primary linear alcohol, lauric acid, soap grease, non-soap grease, and ester based lubricant; and a polymer jacket surrounding the first stack and the second stack.

2. The electrical cable of claim 1, wherein at least one side of at least one of the conductors of the first stack is coated with copper.

3. The electrical cable of claim 1, wherein a width of the top conductor and the bottom conductor of the first stack is less than a width of the middle conductor of the first stack.

4. The electrical cable of claim 1, wherein a width of the first stack is greater than a width of the second stack.

5. The electrical cable of claim 1, wherein a width of the conductors of the first stack is reduced at a top and a bottom of the first stack.

6. An electrical cable, comprising:

a first plurality of generally rectangular cross-section conductors superposed in a first stack adjacent one another;

a second plurality of generally rectangular cross-section conductors superposed in a second stack, wherein the second stack is aligned substantially parallel and coplanar with the first stack;

a width of a top conductor and a bottom conductor of the first stack is less than a middle conductor proximate a middle of the first stack;

a lubrication layer provided between at least two of the conductors of the first stack and between at least two of the conductors of the second stack;

the lubrication layer is selected from the group consisting of solvent based vanishing lubricants, molybdenum disulfide, tungsten disulfide, wax, primary branched alcohol, ester based additive, primary linear alcohol, lauric acid, soap grease, non-soap grease, and ester based lubricant; and a polymer jacket surrounding the first stack and the second stack.

7. The electrical cable of claim 6, wherein a thickness of the top conductor and the bottom conductor of the first stack is less than a thickness of the middle conductor of the first stack.

8. The electrical cable of claim 6, wherein a width of the first stack is greater than a width of the second stack.

9. The electrical cable of claim 7, wherein a thickness of a top conductor and a bottom conductor of the second stack is less than a thickness of a middle conductor proximate a middle of the second stack.

10. The electrical cable of claim 6, wherein a width of a top conductor and a bottom conductor of the second stack is less than a middle conductor proximate a middle of the second stack.

11. The electrical cable of claim 1, wherein a thickness of a top conductor and a bottom conductor of the second stack is less than a thickness of a middle conductor proximate a middle of the second stack.

12. The electrical cable of claim 3, wherein a width of a top conductor and a bottom conductor of the second stack is less than a middle conductor proximate a middle of the second stack.

13. An electrical cable, comprising:

a first plurality of generally rectangular cross-section conductors superposed in a first stack adjacent one another;

a second plurality of generally rectangular cross-section conductors superposed in a second stack, wherein the second stack is aligned substantially parallel and coplanar with the first stack;

a width of a top conductor and a bottom conductor of the first stack is less than a middle conductor proximate a middle of the first stack;

a width of a top conductor and a bottom conductor of the second stack is less than a middle conductor proximate a middle of the second stack;

a thickness of the top conductor and the bottom conductor of the first stack is less than a thickness of the middle conductor of the first stack;

a thickness of the top conductor and the bottom conductor of the second stack is less than a thickness of the middle conductor of the second stack;

a lubrication layer provided between at least two of the conductors of the first stack and at least two of the conductors of the second stack;

the lubrication layer is selected from the group consisting of solvent based vanishing lubricants, molybdenum disulfide, tungsten disulfide, wax, primary branched alcohol, ester based additive, primary linear alcohol, lauric acid, soap grease, non-soap grease, and ester based lubricant; and a polymer jacket surrounding the first stack and the second stack.

* * * * *